US010989368B2

(12) United States Patent
Greenwood et al.

(10) Patent No.: US 10,989,368 B2
(45) Date of Patent: Apr. 27, 2021

(54) NOTIFICATION DEVICE FOR A SURFACE OF A BUILDING INTERIOR

(71) Applicant: Carrier Corporation, Palm Beach Gardens, FL (US)

(72) Inventors: Thomas Greenwood, Terra Ceia, FL (US); Martin Paul Robotham, Bradenton, FL (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/500,760

(22) PCT Filed: Apr. 10, 2018

(86) PCT No.: PCT/US2018/026888

§ 371 (c)(1),
(2) Date: Oct. 3, 2019

(87) PCT Pub. No.: WO2018/191264

PCT Pub. Date: Oct. 18, 2018

(65) Prior Publication Data

US 2020/0124239 A1 Apr. 23, 2020

Related U.S. Application Data

(60) Provisional application No. 62/485,232, filed on Apr. 13, 2017.

(51) Int. Cl.

| | |
|---|---|
| ***F21K 9/68*** | (2016.01) |
| ***F21K 9/66*** | (2016.01) |
| ***F21V 33/00*** | (2006.01) |
| ***G08B 5/36*** | (2006.01) |
| *F21Y 115/10* | (2016.01) |

(52) U.S. Cl.
CPC ..... *F21K 9/68* (2016.08); *F21K 9/66* (2016.08); *F21V 33/0076* (2013.01); *G08B 5/36* (2013.01); *F21Y 2115/10* (2016.08)

(58) Field of Classification Search
CPC ..... F21K 9/68; F21K 9/66; F21K 9/62; F21V 33/0076; F21V 7/0008; F21V 7/00;
(Continued)

(56) References Cited

U.S. PATENT DOCUMENTS 6,739,738 B1 5/2004 Smith
6,788,197 B1 9/2004 Thuillard et al.
(Continued)

FOREIGN PATENT DOCUMENTS

CN 102129755 B 7/2012
DE 102012214357 A1 2/2014
(Continued)

OTHER PUBLICATIONS

ISR/WO, Issued Jul. 3, 2018, 18 pages.

*Primary Examiner* — Hai Phan
*Assistant Examiner* — Anthony D Afrifa-Kyei
(74) *Attorney, Agent, or Firm* — Cantor Colburn LLP

(57) ABSTRACT

A light pattern generating device is provided and includes light sources arrayed at ninety degree intervals from each other and lenses arrayed in respective positional association with the light sources such that, when the light sources are activated, the light sources and the lenses generate at least a UL 1971 compliant light pattern.

19 Claims, 8 Drawing Sheets

(58) Field of Classification Search
CPC .... F21V 7/0016; F21V 23/0457; F21V 5/008; F21V 7/24; F21V 7/28; F21V 11/10; F21V 1/00; F21V 3/00; F21V 9/00; F21V 14/06; F21V 2200/13; F21V 23/0442; F21V 5/002; F21V 7/22; G05B 5/36; F21Y 2115/10; F21Y 2113/00; F21Y 2113/13; F21Y 2113/20; F21S 10/02; F21S 2/00; F21S 4/00; F21S 10/00; F21S 19/00; G01J 3/02; G01J 3/0216; G01J 3/0218; G01J 3/0254; G01J 3/0256; G01J 3/0264; G01J 3/0286; G01J 3/10; G01J 3/50; G01J 1/08; G01J 3/501; G02B 5/0252; G02B 5/0278; G02B 5/0284; G02B 6/0008; G03B 15/06; G09F 13/0404; G09F 13/06; G09F 13/14; G09F 13/22; H05B 35/00; H05B 45/00; H05B 45/20; H05B 45/22; H05B 45/395; F21W 2131/406; Y02B 20/343
See application file for complete search history.

(56) References Cited

U.S. PATENT DOCUMENTS

| | | | |
|---|---|---|---|
| 7,976,187 | B2 | 7/2011 | Villard |
| 8,465,170 | B2 | 6/2013 | Rong et al. |
| 8,591,079 | B2 | 11/2013 | Chang et al. |
| 9,201,051 | B2 | 12/2015 | Lewiner |
| 9,244,010 | B2 | 1/2016 | Wagner et al. |
| 9,251,675 | B2 * | 2/2016 | Carrington ..... G08B 5/36 |
| 9,410,680 | B2 | 8/2016 | Ng et al. |
| 9,541,501 | B2 | 1/2017 | Alleman et al. |
| 9,569,946 | B2 | 2/2017 | Aebersold |
| 9,574,763 | B2 | 2/2017 | Chen |
| 2007/0132575 | A1 | 6/2007 | Ellul |
| 2011/0063582 | A1 * | 3/2011 | Lee ..... F04B 39/06 353/52 |
| 2014/0213094 | A1 * | 7/2014 | Rowlette ..... F21V 19/0035 439/366 |
| 2016/0343226 | A1 | 11/2016 | Fischer et al. |
| 2017/0046935 | A1 | 2/2017 | Allemann et al. |
| 2017/0138563 | A1 * | 5/2017 | Leung ..... G08B 5/38 |

FOREIGN PATENT DOCUMENTS

| | | | |
|---|---|---|---|
| EP | 2093731 | A1 | 8/2009 |
| EP | 2711615 | A1 | 3/2014 |
| EP | 2866214 | A1 | 4/2015 |
| EP | 2345309 | B1 | 11/2020 |
| FR | 2975809 | A1 | 11/2012 |
| WO | 2012035841 | A1 | 8/2009 |
| WO | 2014094401 | A1 | 6/2014 |

* cited by examiner

NOTIFICATION DEVICE FOR A SURFACE OF A BUILDING INTERIOR

CROSS-REFERENCE TO RELATED APPLICATIONS

This application claims the benefit of PCT/US2018/026888 filed Apr. 10, 2018, which claims priority to U.S. Provisional Application No. 62/485,232 filed Apr. 13, 2017, which is incorporated herein by reference in their entirety.

BACKGROUND

The following description relates to notification devices and, more particularly, to a notification device for a surface of a building interior, such as a wall or a ceiling, that uses four light emitting diodes (LEDs) and lenses located on its perimeter.

The UL 1971 standard governs many public mode fire applications in the Americas and the Middle East and is a performance standard (a similar performance standard, EN54, is primarily used in Europe). UL 1971 includes specific light output and distribution requirements to ensure illumination throughout a defined area. The requirements stipulate a minimum flash rate of between about 1 Hz and 2 Hz (e.g., about 1.2 Hz), categorizes minimum light intensities by area: non-sleeping (15 cd), corridor (15 cd) and sleeping areas (110 cd for walls or 177 cd for ceilings). In particular, the UL 1971 standard requires a polar light distribution pattern to enhance the likelihood of alerting hearing impaired individuals throughout an area that an emergency such as a first is occurring (the pattern also includes "compound 45s"—eight light spots around a cross). The term "polar" refers to the way the standard measures light intensity: both horizontally and vertically at viewing angles ranging from 0 to 180 degrees.

For those notification devices that are designed to create UL 1971 compliant output patterns, maintenance of a low device profile has been found to be difficult. With the UL 1971 in effect, traditional notification devices mount strobes over their speakers. This is because generation of the UL 1971 compliant output pattern typically requires light sources that are significantly higher than much of the body of the device in order for the light sources to hit the required output at each required location. While doing so can result in devices that are UL 1971 compliant, such devices have increased device depth and degraded aesthetics as well as an issue of attenuated speaker output.

BRIEF DESCRIPTION

According to one aspect of the disclosure, a light pattern generating device is provided. The light pattern generating device includes light sources arrayed at ninety degree intervals from each other and lenses arrayed in respective positional association with the light sources such that, when the light sources are activated, the light sources and the lenses generate at least a UL 1971 compliant light pattern.

In accordance with additional or alternative embodiments, when the light sources are activated, light source and lens combinations one hundred and eighty degrees apart generate overlapping light output patterns and other light source and lens combinations generate offset light output patterns.

In accordance with additional or alternative embodiments, the light pattern generating device further includes a base and a cover that are both similarly annular or polygonal.

In accordance with additional or alternative embodiments, the light pattern generating device further includes an audio signal emission element.

In accordance with additional or alternative embodiments, the light sources are coplanar and the lenses are coplanar.

In accordance with additional or alternative embodiments, first and second pairs of the light sources which are at one hundred and eighty degree intervals from each other are coaxial.

In accordance with additional or alternative embodiments, the light sources include light emitting diodes (LEDs).

In accordance with additional or alternative embodiments, each lens includes a convex lens element centered at a corresponding one of the light sources and total internal reflector (TIR) and concave lens elements centered at the convex lens element.

According to another aspect of the disclosure, a wall or ceiling mounted notification device is provided. The wall or ceiling notification device includes a base, a cover which is attachable to the base to define an interior, four light sources arrayed within the interior and around a perimeter of the base at ninety degree intervals from each other, circuitry operably disposed in the interior to activate and deactivate the four light sources and lenses. The lenses are arrayed in respective positional association with the four light sources such that, when the four light sources are activated by the circuitry, the four light sources and the four lenses generate a UL 1971 compliant polar light pattern.

In accordance with additional or alternative embodiments, the base and the cover are both similarly annular or polygonal.

In accordance with additional or alternative embodiments, an audio signal emission element is operably disposed in a central region of the interior.

In accordance with additional or alternative embodiments, portions of the cover respectively disposed proximate to corresponding ones of the four light sources and the four lenses are transparent and a central portion of the cover is perforated.

In accordance with additional or alternative embodiments, the four light sources are coplanar and the four lenses are coplanar.

In accordance with additional or alternative embodiments, first and second pairs of the light sources which are at one hundred and eighty degree intervals from each other are coaxial.

In accordance with additional or alternative embodiments, the four light sources include light emitting diodes (LEDs).

In accordance with additional or alternative embodiments, each lens includes a convex lens element centered at a corresponding one of the four light sources and total internal reflector (TIR) and concave lens elements centered at the convex lens element.

According to yet another aspect of the disclosure, a notification system is provided for operation in a building that includes multiple floors respectively defining rooms and hallways and a power supply system. The notification system includes wall or ceiling mounted notification devices operably disposable in the rooms and hallways. Each of the wall or ceiling mounted notification devices includes a base which is attachable to walls or ceilings in the rooms or hallways, four light source and lens combinations arrayed around a perimeter of the base at ninety degree intervals from each other and circuitry which is electrically coupled to the power supply system and which is operable to activate and deactivate the four light source and lens combinations. The four light source and lens combinations are configured to generate a UL 1971 compliant polar light pattern when the light source and lens combinations are activated by the circuitry.

In accordance with additional or alternative embodiments, the four light sources are coplanar and the four lenses are coplanar and first and second pairs of the light sources which are at one hundred and eighty degree intervals from each other are coaxial.

In accordance with additional or alternative embodiments, the four light sources include light emitting diodes (LEDs).

In accordance with additional or alternative embodiments, each lens includes a convex lens element centered at a corresponding one of the four light sources and total internal reflector (TIR) and concave lens elements centered at the convex lens element.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

DETAILED DESCRIPTION

As will be described below, a notification device is provided and locates four light emitting diodes (LEDs)/lens sets at ninety degrees to each other about an outer perimeter thereof. The shape of the notification device is not critical (as long as the shape does not block output light) but for the LED/lens combinations being at the perimeter and located at ninety degrees to each other. The two LED/lens combinations located one hundred and eighty degrees from each other provide for overlapping light output patterns and thus create a combined output maximizing the efficiency of the power used by the notification device while matching the required light output pattern for UL 1971. Likewise, the two LED/lens combinations ninety degrees offset from each other create a similar pattern. Moreover, each LED also creates two off-axis spots of light in compliance with the requirements of the UL 1971 light pattern.

Figure 1:
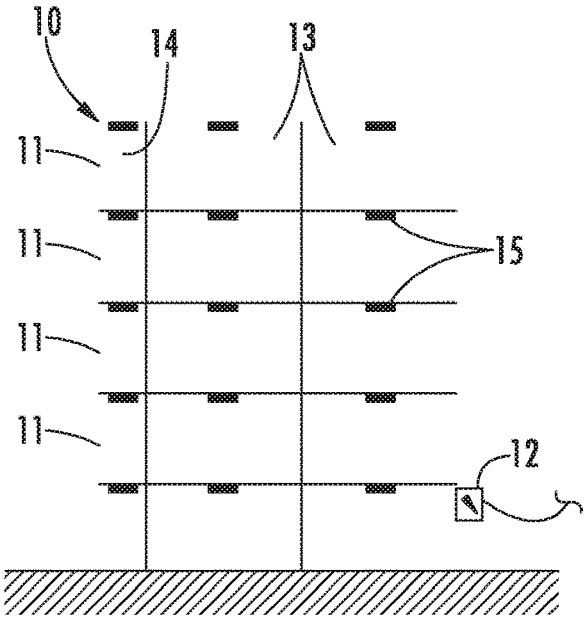
FIG. 1 is a side view of a building in accordance with embodiments.
Figure 2:
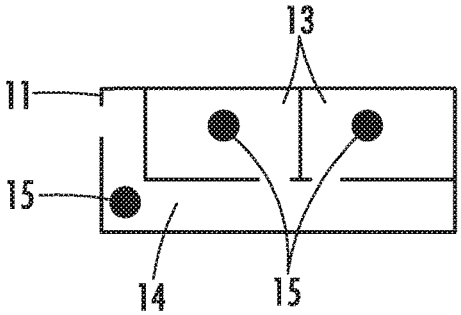
FIG. 2 is a schematic depiction of a floor plan of the building of FIG. 1.

With reference to FIGS. 1 and 2, a building 10 is provided and includes multiple floors 11 and a power supply system 12 that includes one or more batteries and connections to local power grids and thereby delivers electrical power in the form of current from such batteries or grids to various electrical devices throughout each floor 11 of the building 10. Each floor 11 is formed to define one or more rooms 13 and hallways 14 and includes multiple wall or ceiling mounted notification devices 15. The wall or ceiling mounted notification devices 15 receive power from the power supply system 12 and are configured as alarms, such as fire or smoke alarms that are visible to hearing impaired individuals and may be audible to blind individuals. The wall or ceiling mounted notification devices 15 may be further configured with sensing (e.g., fire, smoke, carbon monoxide, etc.) capability. In any case, the wall or ceiling mounted notification devices 15 are compliant with all applicable building codes for whatever jurisdiction the building 10 is located in.

In particular, as will be described below, the wall or ceiling mounted notification devices 15 are UL 1971 compliant in that they are configured to output visible light with a polar light distribution pattern. In addition, the wall or ceiling mounted notification devices 15 are configured to draw minimal power from the power supply system even as they maintain code compliance.

While the wall or ceiling mounted notification devices 15 are described herein as being wall or ceiling mountable, the following description will relate only to the case of ceiling mountings (hereinafter the wall or ceiling mounted notification devices 15 will be referred to as "ceiling mounted notification devices 15"). This is done for purposes of clarity and brevity and is not intended to limit the scope of the discussion in any way.

With reference to FIGS. 3-8, each ceiling mounted notification device 15 includes a base 20 having a perimeter 201, a cover 21 which has a forward curvature but otherwise maintains a relatively low profile, a printed circuit board (PCB) 22 and an inner cover 23.

Although a printed circuit board (PCB) may be used, it is understood that other forms of generated circuitry may be used as well. For example, circuitry generated using 3D printing techniques, a solderless circuit board, a circuitry cube or circuitry that is integrated into base 20, cover 21, or inner cover 23 by various conventional and 3D printing techniques could all be used. A person of skill in the art will understand that where circuitry is integrated into base 20, cover 21 or inner cover 23, features, such as circuitry 40, disposed on and/or connected to the PCB 22 in the following description may be connectably disposed on base 20, cover 21 or inner cover 23, or disposed on an additional structure in place of a PCB.

The base 20 may be attachable to a ceiling or wall or some other similar surface in any of the rooms 13 and hallways 14 of the building 10. The cover 21 is attachable to and about the perimeter 201 of the base 20 to define an interior 24 and the PCB 22 may be operably disposed in the interior 24. The inner cover 23 protectively covers various features, including the PCB 22, in the interior 24. Note that where PCB 22 is integrated into base 20, cover 21 or inner cover 23, interior 24 may be condensed. Each ceiling mounted notification device 15 further includes four light sources 30, circuitry 40 that is operably disposed in the interior 24 and supportively disposed on and/or connected to the PCB 22 to activate and deactivate the four light sources 30 (and to effectively engage the four lenses 50).

In accordance with embodiments, each ceiling mounted notification device 15 may also include an audio signal emission element 60 operably disposed in a central region 241 of the interior 24. The audio signal emission element 60 may be provided as a speaker or piezo-electric sounder that is capable of outputting an audible notification corresponding to the visible notification output by the four light sources 30. The audio signal emission element 60 would be activated and deactivated by the circuitry 40 and is operably disposed in the central region 241 of the interior 24 between the four light sources 30.

The cover 21 has multiple portions. Among these are first portions 211 and a central portion 212. The first portions 211 are respectively disposed proximate to corresponding ones of the four light sources 30 and the four lenses 50. The first portions 211 may be transparent to permit light output from the four light sources 30 and the four lenses 50 to pass through. The central portion 212 is disposed proximate to the central region 241 of the interior 24 and, where applicable, the audio signal emission element 60. The central portion 212 may be perforated to allow audio signals to pass through. The remaining portions of the cover 21 may be provided as generally opaque and rigid portions that are supportive of the first portions 211 and the central portion 212.

In certain embodiments, all portions of the cover 21 may be rigid and supportive, with portions 211 transparent, and remaining portions of the cover 21 opaque. In certain embodiments, the central portion 212 may be perforated, all and all remaining portions of the cover 21 may be rigid and supportive, with portions 211 transparent, and remaining portions of the cover 21 opaque.

The four light sources 30 are arrayed within the interior 24 and around the perimeter 201 of the base 20 at ninety degree intervals from each other. The four light sources 30 may be substantially coplanar with each other. The four lenses 50 are arrayed in respective positional association with the four light sources 30 and may be substantially coplanar with each other. The four lenses 50 are located respectively proximate to corresponding ones of the four light sources 30 and are thus disposed at ninety degree intervals from one another. The four light sources 30 and the four lenses 50 cooperatively define a first light source and lens combination $\mathbf{3050}_1$ on an X-axis, a second light source and lens combination $\mathbf{3050}_2$ on a Y-axis, a third light source and lens combination $\mathbf{3050}_3$ on the X-axis and a fourth light source and lens combination $\mathbf{3050}_4$ on the Y-axis (see FIG. 4).

Figure 5:
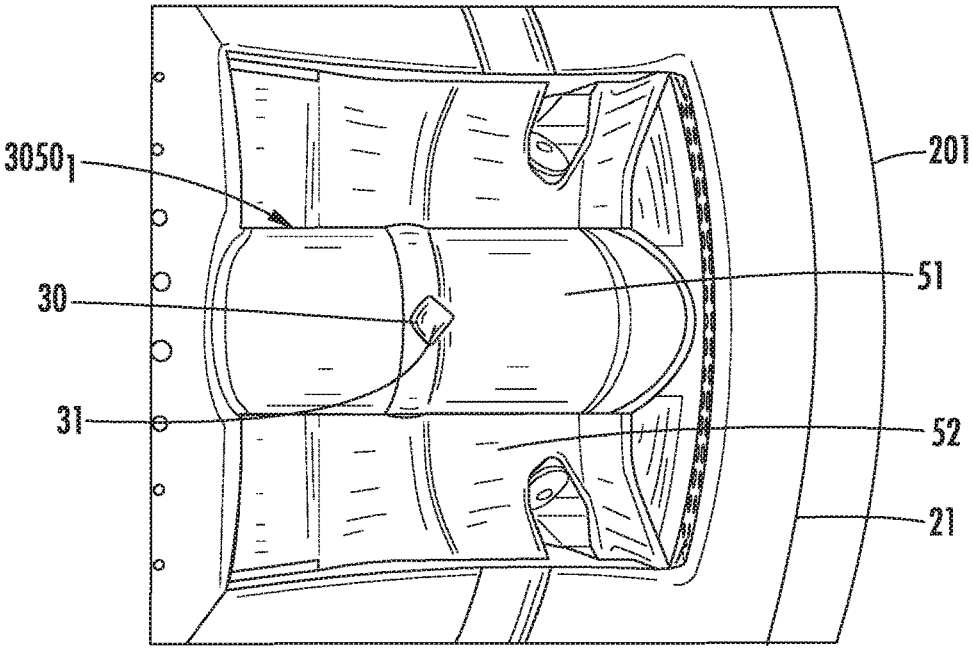
FIG. 5 is an enlarged view of the outlined portion of FIG. 4.
Figure 6:
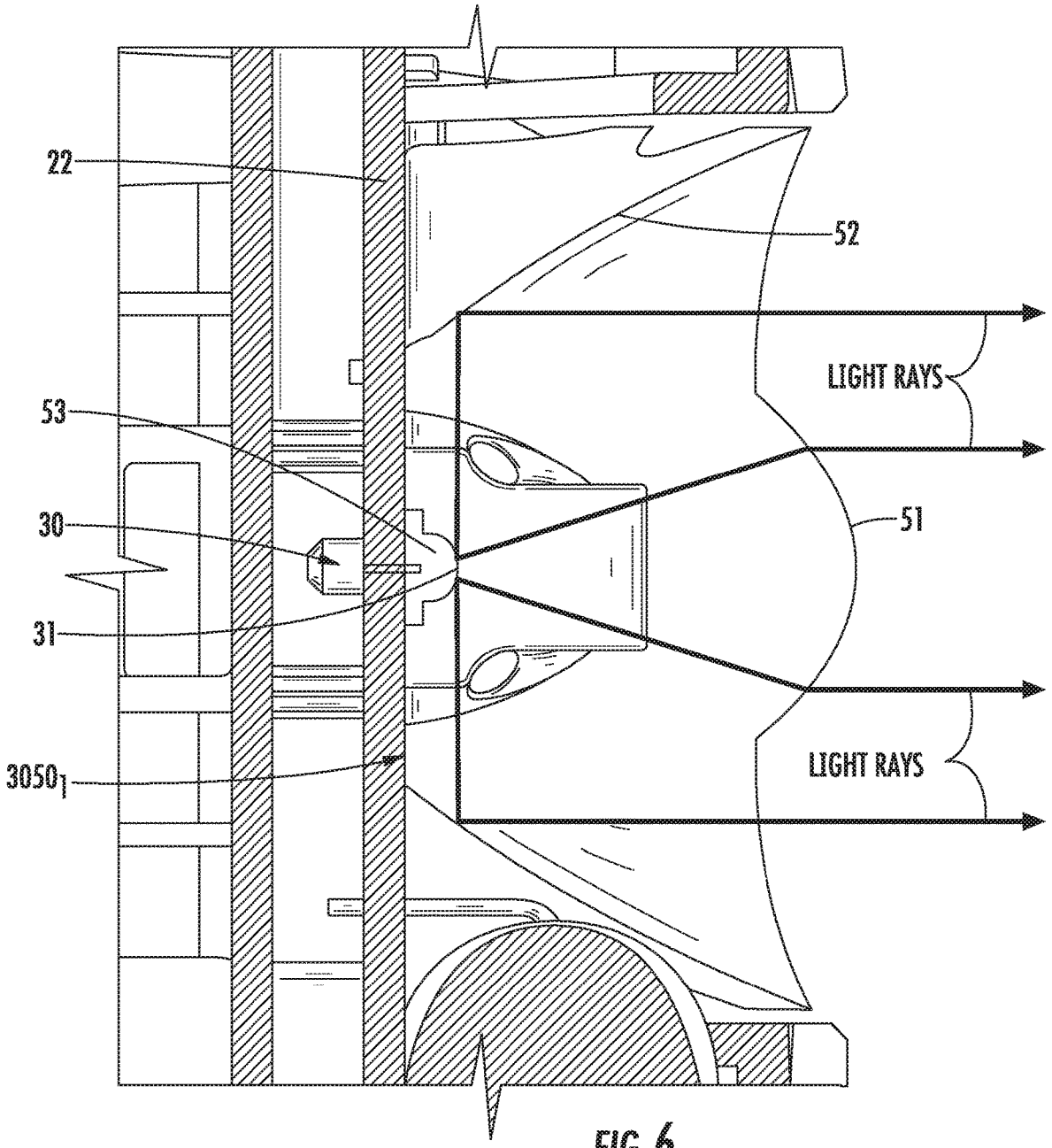
FIG. 6 is a cross-sectional view of the wall or ceiling mounted notification device of FIGS. 3 and 4 taken along lines 6-6 of FIG. 4.
Figure 7:
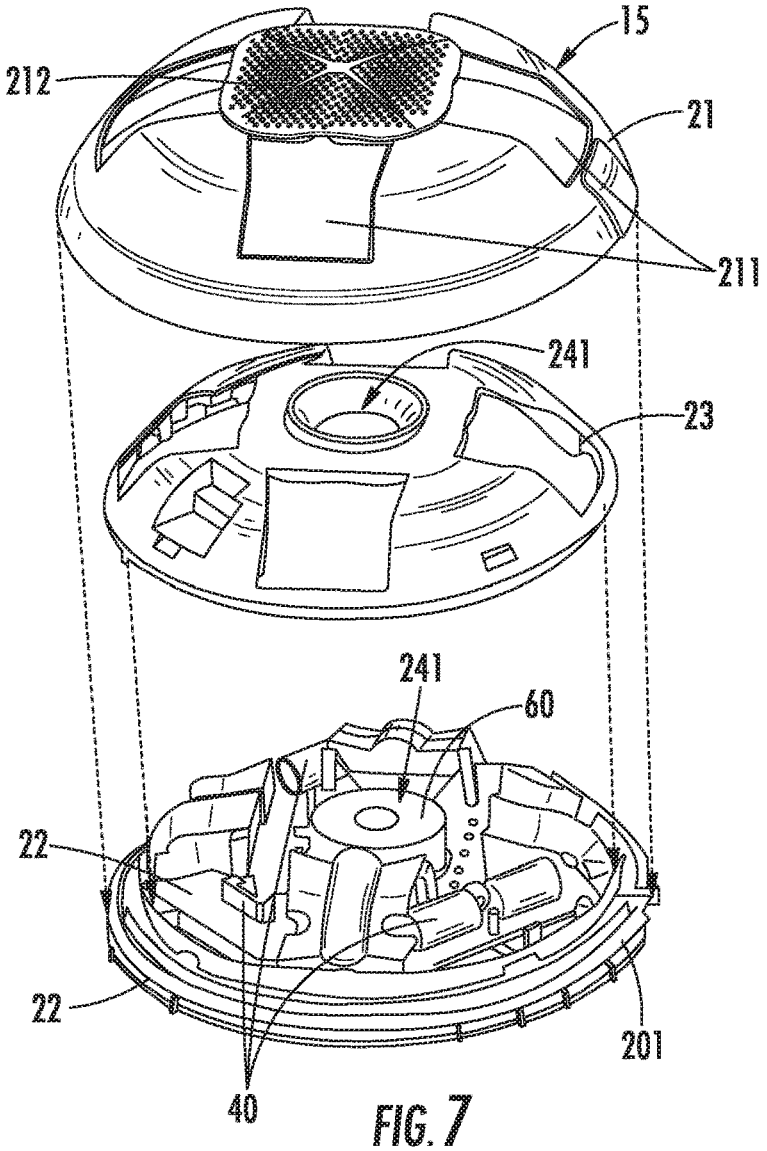
FIG. 7 is an exploded perspective view of the wall or ceiling mounted notification device of FIGS. 3 and 4.
Figure 8:
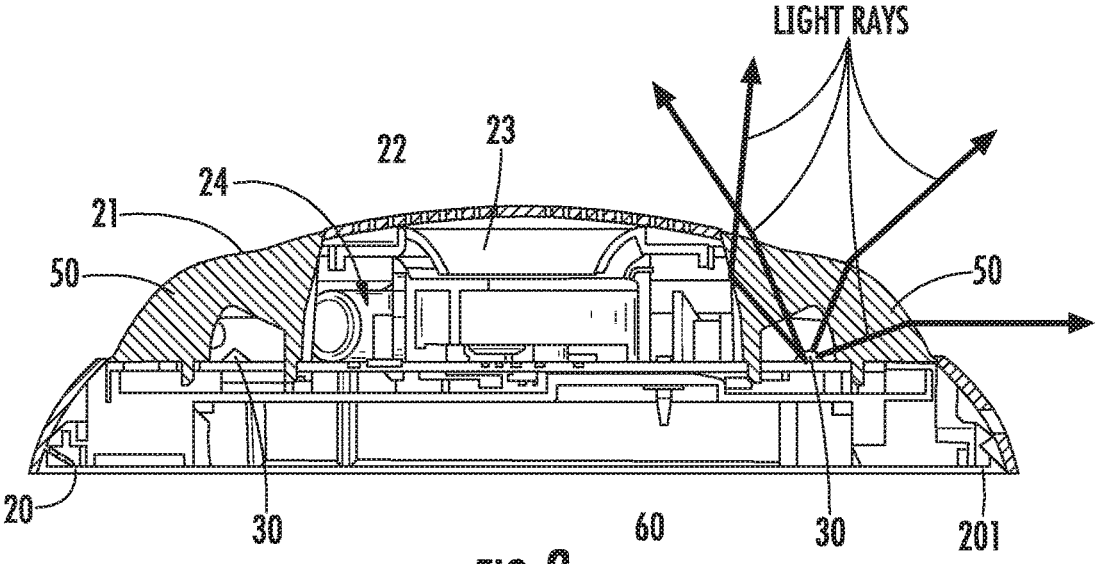
FIG. 8 is a cross-sectional view of the wall or ceiling mounted notification device of FIGS. 3 and 4 taken along lines 8-8 of FIG. 4.

In accordance with embodiments and as shown in FIGS. 5 and 6, the four light sources 30 may each be provided as a light emitting diode (LED) 31 although it is to be understood that any type of light source could be used to the extent that its power requirement does not unduly drain power from the power supply system 12. In accordance with further embodiments, the four lenses 50 may each include a convex lens element 51, a concave lens element 52 and a total internal reflector (TIR) element 53 where such convexity or concavity is relative to a circumferential dimension defined about the central portion 212. In such cases, the convex lens element 51 would be centered at a corresponding one of the four light sources 30 and could be transparent or reflective whereas the concave lens element 52 and the TIR element 53 would be centered at the convex lens element 51 and could be substantially reflective of any light emitted by the corresponding one of the four light sources 30 and reflected thereon by the convex lens element 51.

Figure 3:
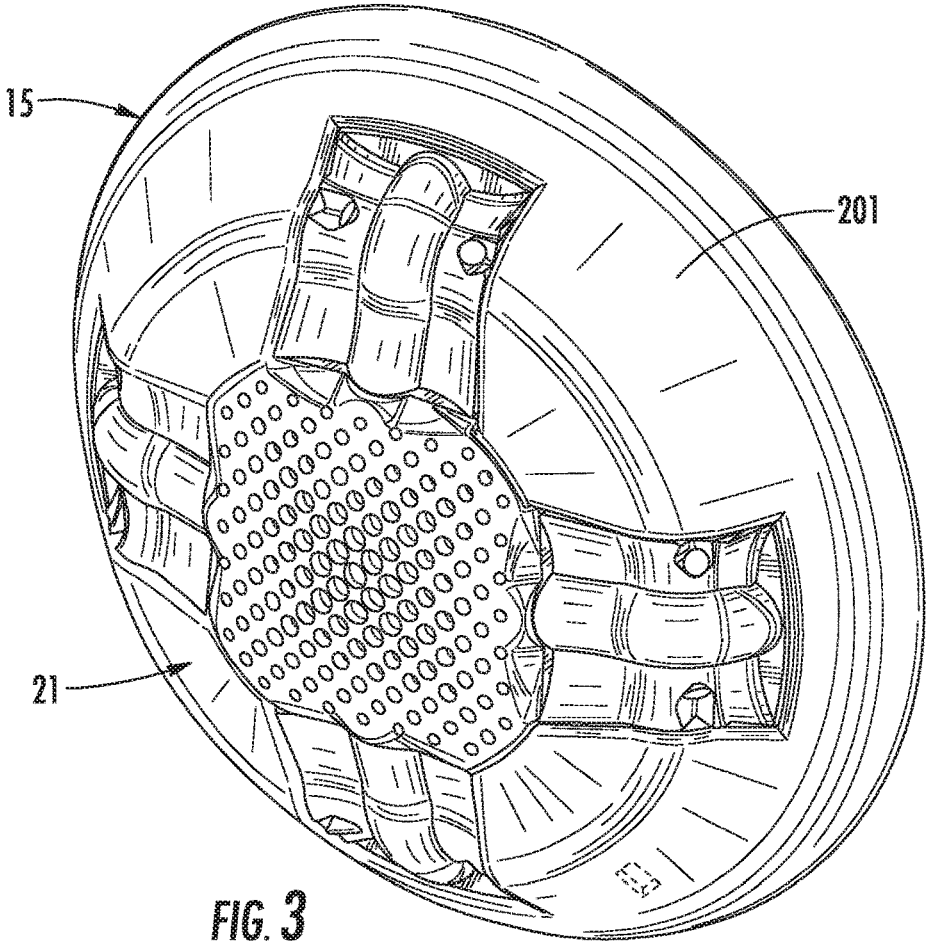
FIG. 3 is a perspective view of a wall or ceiling mounted notification device in accordance with embodiments.
Figure 4:
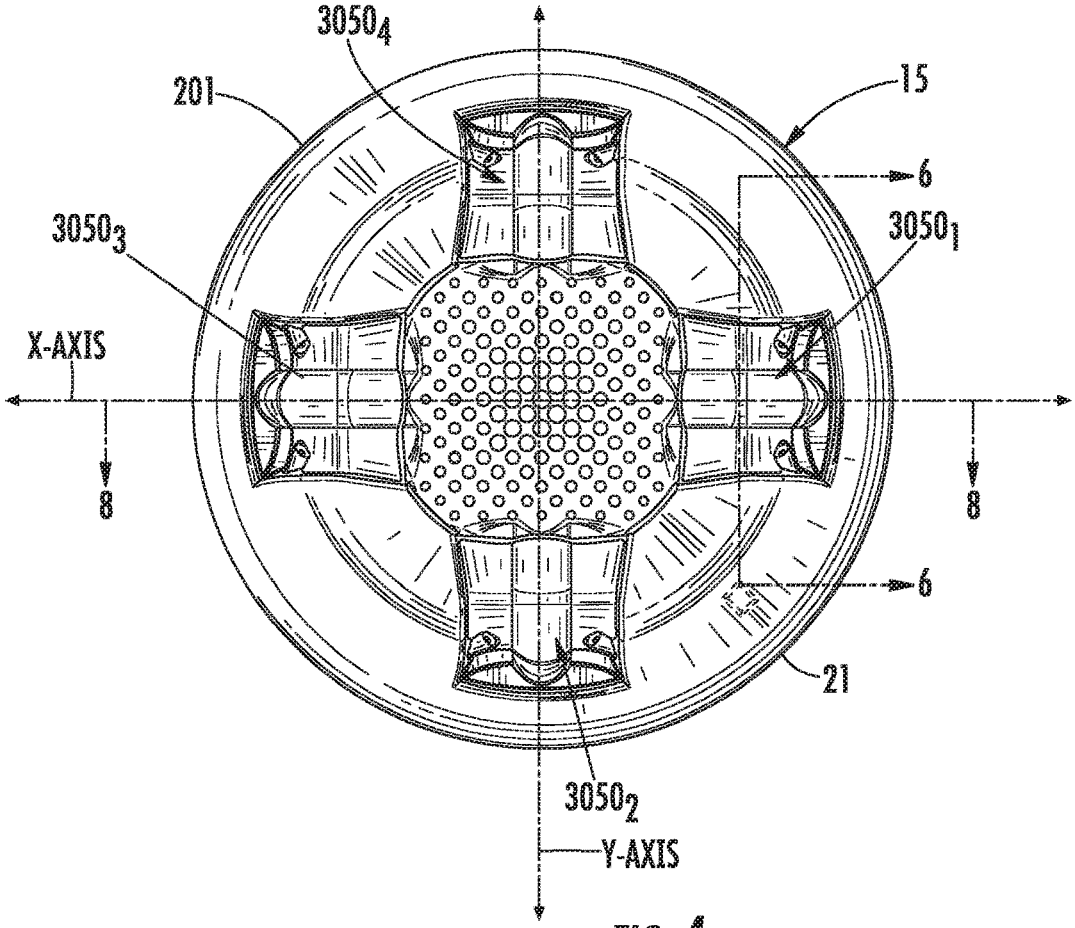
FIG. 4 is a top-down view of the wall or ceiling mounted notification device of FIG. 3 in accordance with embodiments.
Figure 11:
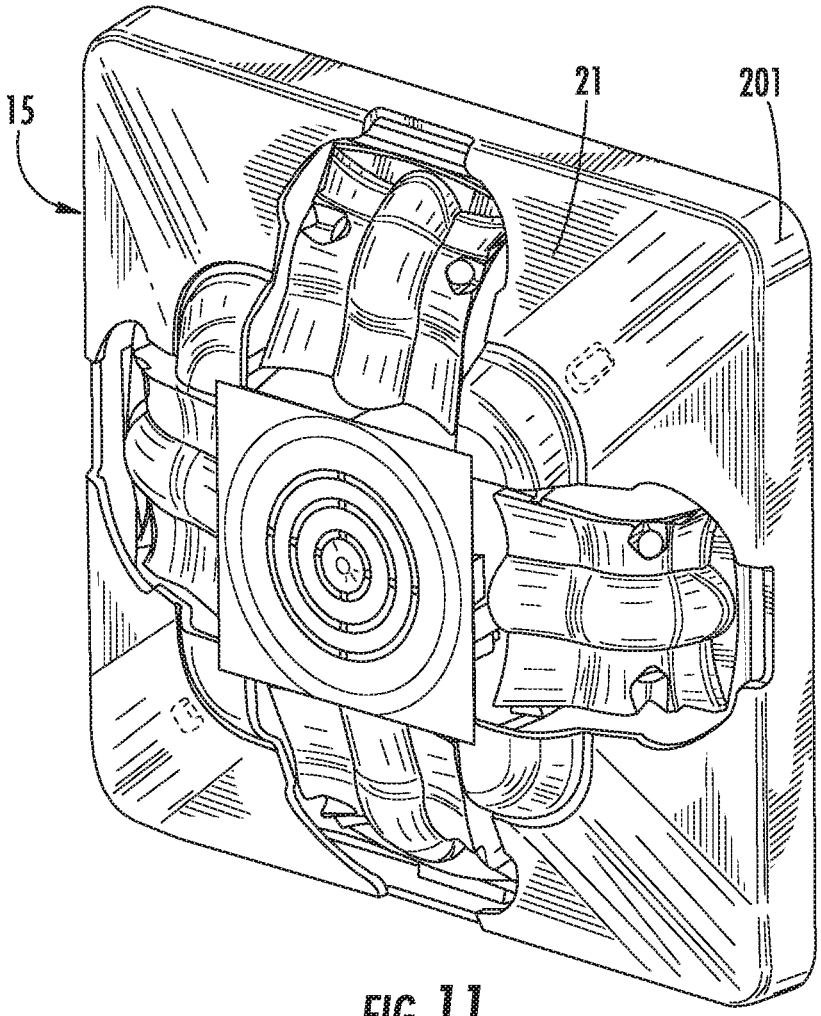
FIG. 11 is a top-down view of a wall or ceiling mounted notification device in accordance with alternative embodiments.

In accordance with embodiments and, as shown in FIG. 3 (and FIG. 11 to be described below), the components of the four lenses 50 may have a curvature that generally follows the profile shape of the cover 21 with increasing distance from the central portion 212. That is, with increasing distance from the central portion 212, the convex lens element 51 and the concave lens element 52 may curve or bend toward a plane of the base 20.

The first light source and lens combination $\mathbf{3050}_1$ is separated from the second light source and lens combination $\mathbf{3050}_2$ and the fourth light source and lens combination $\mathbf{3050}_4$ by ninety degree intervals and is separated from the third light source and lens combination $\mathbf{3050}_3$ by a one hundred and eighty degree interval. The second light source and lens combination $\mathbf{3050}_2$ is separated from the first light source and lens combination $\mathbf{3050}_1$ and the third light source and lens combination $\mathbf{3050}_3$ by ninety degree intervals and is separated from the fourth light source and lens combination $\mathbf{3050}_4$ by a one hundred and eighty degree interval. The third light source and lens combination $\mathbf{3050}_3$ is separated from the second light source and lens combination $\mathbf{3050}_2$ and the fourth light source and lens combination $\mathbf{3050}_4$ by ninety degree intervals and is separated from the first light source and lens combination $\mathbf{3050}_1$ by a one hundred and eighty degree interval. The fourth light source and lens combination $\mathbf{3050}_4$ is separated from the first light source and lens combination $\mathbf{3050}_1$ and the third light source and lens combination $\mathbf{3050}_3$ by ninety degree intervals and is separated from the second light source and lens combination $\mathbf{3050}_2$ by a one hundred and eighty degree interval.

With this configuration, when the four light sources 30 are activated by the circuitry 40, the first-fourth light source and lens combinations $\mathbf{3050}_{1\text{-}4}$ generate at least a UL 1971 compliant polar light pattern. More generally, when the four light sources 30 are activated by the circuitry 40, those light source and lens combinations that are one hundred and eighty degrees apart generate overlapping light output patterns and the other light source and lens combinations generate offset light output patterns.

That is, the first and third light source and lens combinations $\mathbf{3050}_{1,3}$, which are substantially coaxial with one another along an X-axis, cooperatively output visible light in a first or X-Z plane and the second and fourth light source and lens combinations $\mathbf{3050}_{2,4}$, which are substantially coaxial with one another along a Y-axis, cooperatively output visible light in a second or Y-Z plane that is orthogonal and, in some cases, perpendicular with the first or X-Z plane.

Figure 9A:
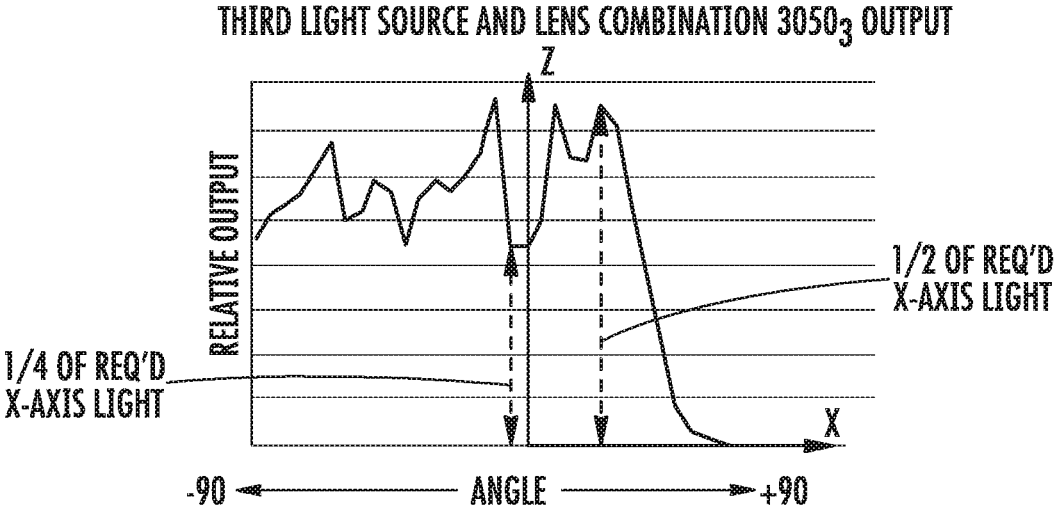
FIG. 9A is a graphical depiction of an output of a first one of four light source/lens combinations of the wall or ceiling mounted notification device of FIGS. 3 and 4.
Figure 9B:
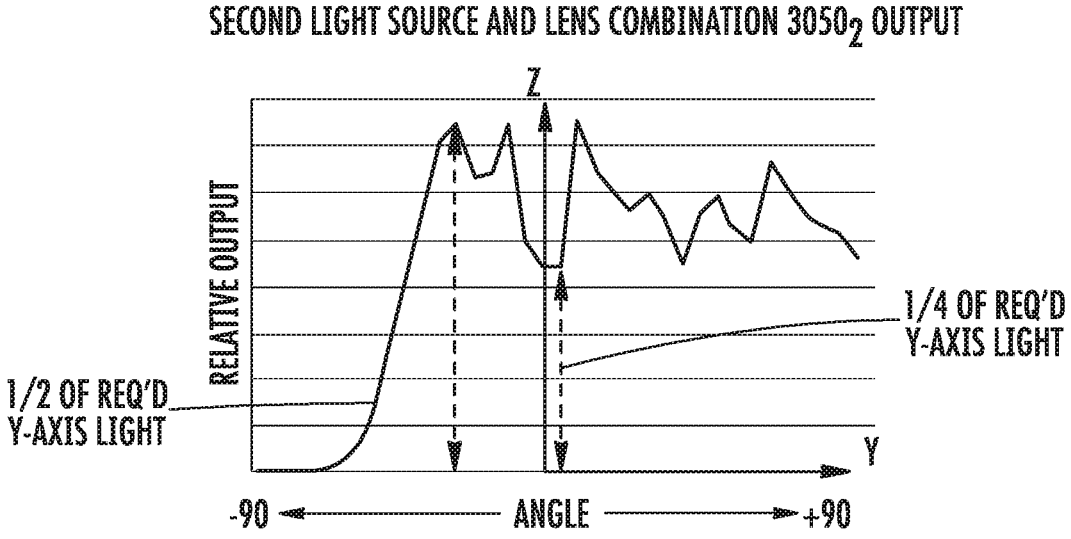
FIG. 9B is a graphical depiction of an output of a second one of four light source/lens combinations of the wall or ceiling mounted notification device of FIGS. 3 and 4.
Figure 9C:
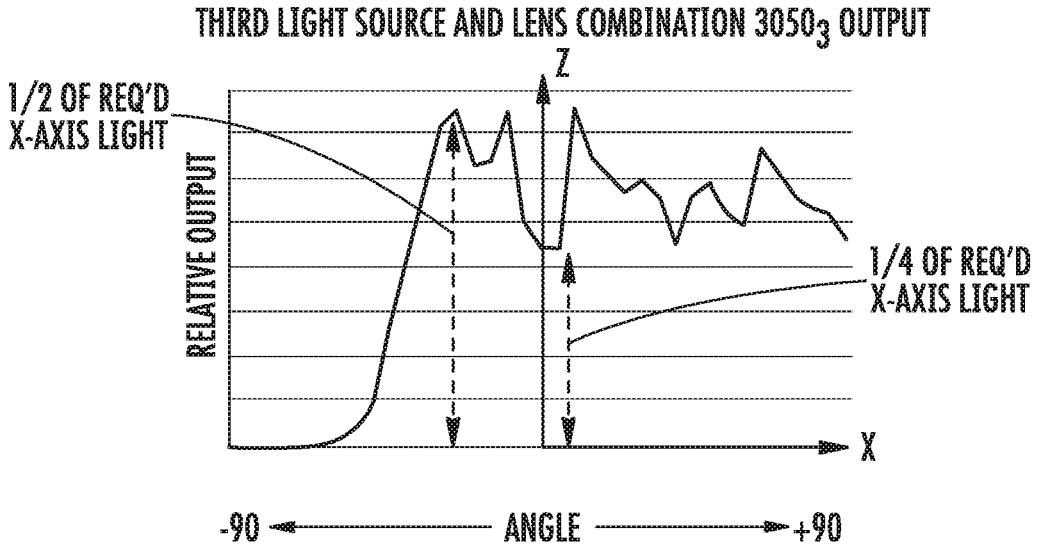
FIG. 9C is a graphical depiction of an output of a third one of four light source/lens combinations of the wall or ceiling mounted notification device of FIGS. 3 and 4.
Figure 9D:
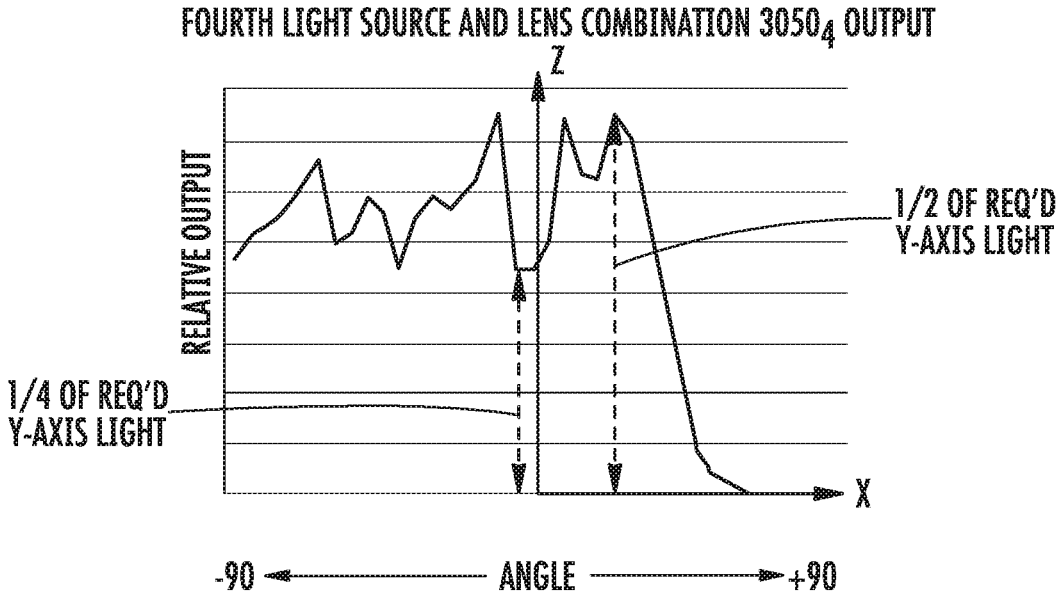
FIG. 9D is a graphical depiction of an output of a fourth one of four light source/lens combinations of the wall or ceiling mounted notification device of FIGS. 3 and 4.

With reference to FIGS. 9A-9D, the respective outputs of the first-fourth light source and lens combinations $\mathbf{3050}_{1\text{-}4}$ are graphically depicted and illustrate the contribution provided by each one of the first-fourth light source and lens combinations $\mathbf{3050}_{1\text{-}4}$. As shown in FIG. 9A, the first light source and lens combination $\mathbf{3050}_1$ provides about ¼ of the overall UL 1971 requirement for light output at and around the zero angle position (i.e., the center of the ceiling mounted notification device 15) and about ½ of the UL 1971 requirement for light output along the X-axis offset from the zero angle position. Similarly, as shown in FIG. 9B, the second light source and lens combination $\mathbf{3050}_2$ provides about ¼ of the overall UL 1971 requirement for light output at and around the zero angle position and about ½ of the UL 1971 requirement for light output along the Y-axis offset from the zero angle position. As shown in FIG. 9C, the third light source and lens combination $\mathbf{3050}_3$ provides about ¼ of the overall UL 1971 requirement for light output at and around the zero angle position (i.e., the center of the ceiling mounted notification device 15) and about ½ of the UL 1971 requirement for light output along the X-axis offset from the zero angle position. Similarly, as shown in FIG. 9D, the fourth light source and lens combination $\mathbf{3050}_4$ provides about ¼ of the overall UL 1971 requirement for light output at and around the zero angle position and about ½ of the UL 1971 requirement for light output along the Y-axis offset from the zero angle position.

Figure 10A:
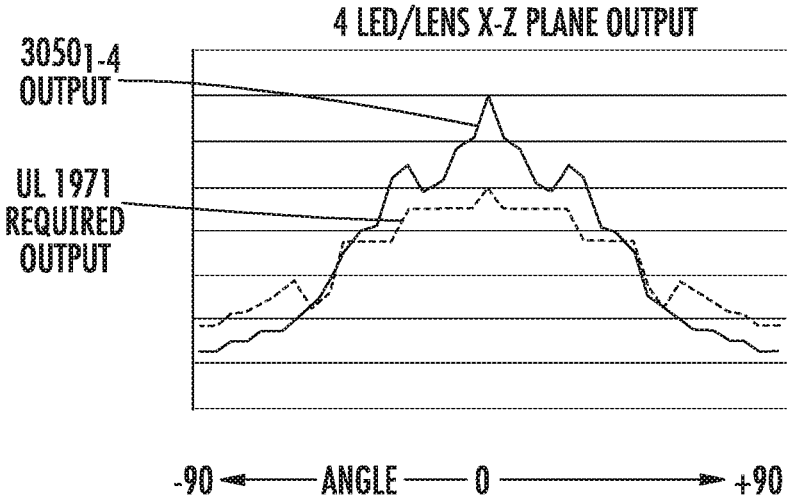
FIG. 10A is a graphical depiction of an output of four light source/lens combinations in an X-Z plane of the wall or ceiling mounted notification device of FIGS. 3 and 4.
Figure 10B:
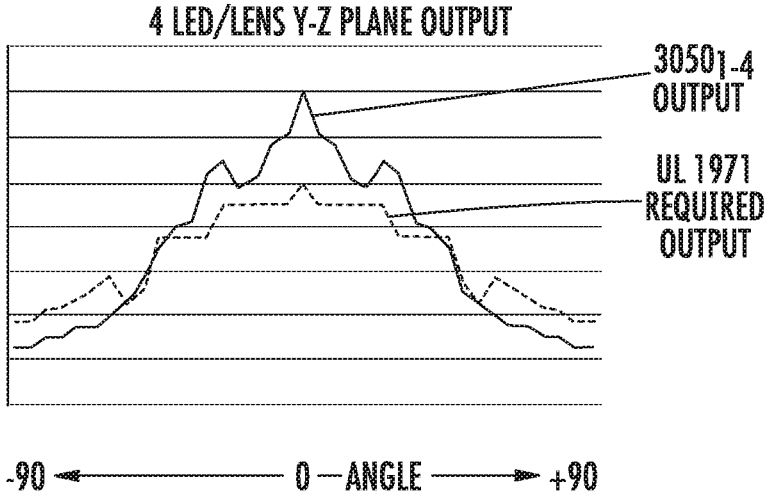
FIG. 10B is a graphical depiction of an output of four light source/lens combinations in a Y-Z plane of the wall or ceiling mounted notification device of FIGS. 3 and 4.

Thus, with reference to FIGS. 10A and 10B, when the respective outputs of the first-fourth light source and lens combinations $\mathbf{3050}_{1\text{-}4}$ are combined, the resulting provision of light meets or exceeds the UL 1971 requirement at the zero angle position and along the X-axis (see FIG. 10A in which the X-Z plane output is shown) and the Y-axis (see FIG. 10B in which the Y-Z plane output is shown).

The respective outputs of the UL 1971 requirement and of the combination of the first-fourth light source and lens combinations $\mathbf{3050}_{1\text{-}4}$ may be expressed as a percentage of the rated output at the zero angle position and surrounding positions as follows:

| | % of rated output | |
|---|---|---|
| Angle | UL Minimum | $3050_{1\text{-}4}$% |
| −90 | 25% | 31% |
| −85 | 25% | 38% |
| −80 | 30% | 43% |
| −75 | 30% | 46% |
| −70 | 35% | 50% |
| −65 | 35% | 58% |
| −60 | 40% | 71% |
| −55 | 45% | 60% |
| −50 | 55% | 61% |
| −45 | 75% | 75% |
| −40 | 75% | 103% |
| −35 | 75% | 106% |
| −30 | 75% | 117% |
| −25 | 90% | 121% |
| −20 | 90% | 103% |
| −15 | 90% | 99% |
| −10 | 90% | 122% |
| −5 | 90% | 118% |
| 0 | 100% | 150% |
| 5 | 90% | 118% |
| 10 | 90% | 122% |
| 15 | 90% | 99% |
| 20 | 90% | 103% |

-continued

| | % of rated output | |
|---|---|---|
| Angle | UL Minimum | $3050_{1\text{-}4}$% |
| 25 | 90% | 121% |
| 30 | 75% | 117% |
| 35 | 75% | 106% |
| 40 | 75% | 103% |
| 45 | 75% | 75% |
| 50 | 55% | 61% |
| 55 | 45% | 60% |
| 60 | 40% | 71% |
| 65 | 35% | 58% |
| 70 | 35% | 50% |
| 75 | 30% | 46% |
| 80 | 30% | 43% |
| 85 | 25% | 38% |
| 90 | 25% | 31% |

However, depending on lens and LED variability and other variability, for example as noted below, the percentages may be higher or lower, nevertheless, the respective outputs of the combination of the first-fourth light source and lens combinations $\mathbf{3050}_{1\text{-}4}$ are the same or greater than the UL 1971 requirement.

While the shape of each of the ceiling mounted notification device 15 is not limited to any shape in particular and can in fact vary from one to another, the embodiments of FIGS. 3-7 generally relate to ceiling mounted notification devices 15 that are annular or circular in shape. This is done for clarity and brevity and it is to be understood that other shapes are possible. For example, with reference to FIG. 11, the ceiling mounted notification devices 15 may have polygonal shapes in some cases. Regardless, the ceiling mounted notification devices 15 are UL 1971 compliant.

The ceiling mounted notification devices 15 described herein will reduce overall current consumption as compared to currently available devices and allow for more devices to be powered from a same power supply system 12 while reducing overall system costs. Specifically, the described ceiling mounted notification devices 15 allow for ultra-low current draw while providing illumination throughout a defined area; resulting in a higher light candela with a shorter flash duration than conventional LED strobe configurations. For example, the input current required for an LED meeting the latest UL and NFPA requirements for maximum flash duration of 20 milliseconds may be reduced significantly below those of both Xenon and conventional LED strobes. In other words, less energy is required per flash.

As an example of the reduction in energy required to generate a flash of maximum duration of 20 milliseconds, 4 LED strobes for the present invention generate 300-400 candela per joule. In contrast, a conventional Xenon strobe may require approximately 6-7 times as much energy for the same light output (over a shorter period of time, e.g. roughly 0.5 milliseconds). The lower current draw allows for the use of smaller wire sizes for audio and strobe connections, increases the number of devices per Notification Appliance Circuit (NAC) Loop and/or allows for increases of NAC Loop distances.

Thus, significantly reduced current levels are beneficial at least because more devices can be powered from any given supply, thus reducing the number of supplies needed for large systems; and/or reduced wire size; and/or longer cable runs. These benefits can reduce the overall cost of installation. The design of the ceiling mounted notification devices 15 also frees up central parts thereof for a speaker or sounder and allows for a relatively lower device profile.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A light pattern generating device, comprising:

light sources arrayed at ninety degree intervals from each other; and lenses arrayed in respective positional association with the light sources such that, when the light sources are activated, the light sources and the lenses generate at least a UL 1971 compliant light pattern, wherein, when the light sources are activated, light source and lens combinations one hundred and eighty degrees apart generate overlapping light output patterns and other light source and lens combinations generate offset light output patterns.

2. The light pattern generating device according to claim 1, further comprising a base and a cover that are both similarly annular or polygonal.

3. The light pattern generating device according to claim 1, further comprising an audio signal emission element.

4. The light pattern generating device according to claim 1, wherein the light sources are coplanar and the lenses are coplanar.

5. The light pattern generating device according to claim 1, wherein first and second pairs of the light sources which are at one hundred and eighty degree intervals from each other are coaxial.

6. The light pattern generating device according to claim 1, wherein the light sources comprise light emitting diodes (LEDs).

7. The light pattern generating device according to claim 1, wherein each lens comprises a convex lens element centered at a corresponding one of the light sources and total internal reflector (TIR) and concave lens elements centered at the convex lens element.

8. A wall or ceiling mounted notification device, comprising: a base;

a cover which is attachable to the base to define an interior;

four light sources arrayed within the interior and around a perimeter of the base at ninety degree intervals from each other;

circuitry operably disposed in the interior to activate and deactivate the four light sources; and lenses arrayed in respective positional association with the four light sources such that, when the four light sources are activated by the circuitry, the four light sources and the four lenses generate a UL 1971 compliant polar light pattern, wherein, when the light sources are activated, light source and lens combinations one hundred and eighty degrees apart generate overlapping light output patterns and other light source and lens combinations generate offset light output patterns.

9. The wall or ceiling mounted notification device according to claim 8, wherein the base and the cover are both similarly annular or polygonal.

10. The wall or ceiling mounted notification device according to claim 8, further comprising an audio signal emission element operably disposed in a central region of the interior.

11. The wall or ceiling mounted notification device according to claim 8, wherein portions of the cover respectively disposed proximate to corresponding ones of the four light sources and the four lenses are transparent and a central portion of the cover is perforated.

12. The wall or ceiling mounted notification device according to claim 8, wherein the four light sources are coplanar and the four lenses are coplanar.

13. The wall or ceiling mounted notification device according to claim 8, wherein first and second pairs of the light sources which are at one hundred and eighty degree intervals from each other are coaxial.

14. The wall or ceiling mounted notification device according to claim 8, wherein the four light sources comprise light emitting diodes (LEDs).

15. The wall or ceiling mounted notification device according to claim 8, wherein each lens comprises a convex lens element centered at a corresponding one of the four light sources and total internal reflector (FIR) and concave lens elements centered at the convex lens element.

16. A notification system for operation in a building that comprises multiple floors respectively defining rooms and hallways and a power supply system, the notification system comprising:

wall or ceiling mounted notification devices operably disposable in the rooms and hallways, each of the wall or ceiling mounted notification devices comprising:

a base which is attachable to walls or ceilings in the rooms or hallways;

four light source and lens combinations arrayed around a perimeter of the base at ninety degree intervals from each other; and circuitry which is electrically coupled to the power supply system and which is operable to activate and deactivate the four light source and lens combinations, wherein the four light source and lens combinations are configured to generate a UL 1971 compliant polar light pattern when the light source and lens combinations are activated by the circuitry, and wherein, when the light sources are activated, light source and lens combinations one hundred and eighty degrees apart generate overlapping light output patterns and other light source and lens combinations generate offset light output patterns.

17. The notification system according to claim 16, wherein:

the four light sources are coplanar and the four lenses are coplanar, and first and second pairs of the light sources which are at one hundred and eighty degree intervals from each other are coaxial.

18. The notification system according to claim 16, Wherein the four light sources comprise light emitting diodes (LEDs).

19. The notification system according to claim 16, wherein each lens comprises a convex lens element centered at a corresponding one of the four light sources and total internal reflector (TER) and concave lens elements centered at the convex lens element.

* * * * *